US011217944B2

(12) United States Patent
Trout et al.

(10) Patent No.: US 11,217,944 B2
(45) Date of Patent: Jan. 4, 2022

(54) SHIELDING STRUCTURE FOR A CONNECTOR ASSEMBLY

(71) Applicant: TE Connectivity Services GmbH, Schaffhausen (CH)

(72) Inventors: David Allison Trout, Lancaster, PA (US); Douglas Edward Shirk, Elizabethtown, PA (US); Jeffrey Byron McClinton, Harrisburg, PA (US); Justin Dennis Pickel, Hummelstown, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 45 days.

(21) Appl. No.: 16/776,725

(22) Filed: Jan. 30, 2020

(65) Prior Publication Data

US 2021/0242632 A1 Aug. 5, 2021

(51) Int. Cl.

| | |
|---|---|
| ***H01R 13/648*** | (2006.01) |
| ***H01R 13/6588*** | (2011.01) |
| ***H01R 13/6587*** | (2011.01) |
| ***H01R 13/428*** | (2006.01) |
| ***H01R 13/506*** | (2006.01) |
| *H01R 107/00* | (2006.01) |

(52) U.S. Cl.

CPC ..... *H01R 13/6588* (2013.01); *H01R 13/428* (2013.01); *H01R 13/506* (2013.01); *H01R 13/6587* (2013.01); *H01R 2107/00* (2013.01)

(58) Field of Classification Search

CPC ..... H01R 13/6588; H01R 13/428; H01R 13/506; H01R 13/6587; H01R 2107/00; H01R 13/514; H01R 13/6471; H01R 13/6585

USPC ..... 439/607.01, 626, 78

See application file for complete search history.

(56) References Cited

U.S. PATENT DOCUMENTS

| | | | | |
|---|---|---|---|---|
| 4,881,905 | A | 11/1989 | Delmer, Jr. et al. | |
| 7,811,129 | B2 | 10/2010 | Glover et al. | |
| 8,449,330 | B1 * | 5/2013 | Schroll | H01R 13/514 439/607.06 |
| 9,608,382 | B2 * | 3/2017 | McClellan | H01R 13/6587 |
| 9,917,406 | B1 | 3/2018 | Iwasaki et al. | |
| 10,148,025 | B1 | 12/2018 | Trout et al. | |
| 10,186,811 | B1 | 1/2019 | Trout et al. | |
| 10,431,936 | B2 * | 10/2019 | Horning | H01R 13/6473 |
| 10,699,823 | B2 * | 6/2020 | Blackburn | H01B 7/02 |

(Continued)

*Primary Examiner* — Abdullah A Riyami
*Assistant Examiner* — Nelson R. Burgos-Guntin

(57) ABSTRACT

A header assembly includes a header housing having a header cavity. The header assembly includes header signal contacts received in corresponding signal contact channels having mating ends arranged in the header cavity for mating with the receptacle assembly. The header assembly includes header ground contacts received in corresponding ground contact channels. Each header ground contact includes shield walls forming a shield cavity receiving header signal contacts to provide electrical shielding for the header signal contacts. The shield walls include an end wall extending between first and second side walls. Each header ground contact includes a mating protrusion that extends outward relative to the shield cavity from the corresponding shield wall. The mating protrusion is configured to engage a conductive insert of the receptacle assembly used to electrically common each of the header ground contacts.

20 Claims, 8 Drawing Sheets

(56) References Cited

U.S. PATENT DOCUMENTS

| | | | | |
|---|---|---|---|---|
| 10,944,214 | B2 * | 3/2021 | Gailus | H01R 12/7082 |
| 2013/0017722 | A1 * | 1/2013 | Davis | H01R 13/6585<br>439/607.09 |
| 2013/0149899 | A1 * | 6/2013 | Schroll | H01R 13/65914<br>439/607.01 |
| 2014/0051295 | A1 * | 2/2014 | Westman | H01R 13/6586<br>439/626 |
| 2015/0031238 | A1 * | 1/2015 | Davis | H01R 13/6585<br>439/607.05 |
| 2015/0064968 | A1 * | 3/2015 | Davis | H01R 13/6587<br>439/607.02 |
| 2015/0104977 | A1 * | 4/2015 | Hamner | H01R 12/716<br>439/626 |
| 2015/0200496 | A1 * | 7/2015 | Simpson | H01R 13/5841<br>439/607.08 |
| 2015/0236450 | A1 * | 8/2015 | Davis | H01R 13/6581<br>439/78 |
| 2015/0280380 | A1 * | 10/2015 | Jeon | H01R 43/24<br>439/682 |
| 2015/0333420 | A1 * | 11/2015 | Davis | H01R 9/24<br>439/712 |
| 2018/0026400 | A1 * | 1/2018 | Morgan | H01R 12/52<br>439/78 |
| 2019/0237911 | A1 * | 8/2019 | Munoz | H01R 13/6587 |
| 2020/0091660 | A1 * | 3/2020 | Trout | H01R 13/6594 |
| 2020/0227865 | A1 * | 7/2020 | Rossman | H01R 13/6594 |

* cited by examiner

SHIELDING STRUCTURE FOR A CONNECTOR ASSEMBLY

BACKGROUND OF THE INVENTION

The subject matter herein relates generally to connector assemblies.

Some electrical systems utilize connector assemblies, such as header assemblies and receptacle assemblies, to interconnect two circuit boards, such as a motherboard and daughtercard. The connector assemblies include contact modules having contacts terminated to the circuit boards. High speed connector assemblies suffer from problems with cross talk and can exhibit higher than desirable insertion loss due to insufficient shielding. For example, gaps or spaces in shielding through the connector assemblies can result in reduced connector performance.

A need remains for a cost effective and reliable shielding structure for electrical connector assemblies.

BRIEF DESCRIPTION OF THE INVENTION

In one embodiment, a header assembly is provided. The header assembly includes a header housing having a header cavity between a mating end of the header housing and a base wall of the header housing. The mating end is configured to be mated with a receptacle assembly. The base wall includes signal contact channels and ground contact channels. The header assembly includes header signal contacts received in corresponding signal contact channels. The header signal contacts have mating ends arranged in the header cavity for mating with the receptacle assembly. The header assembly includes header ground contacts received in corresponding ground contact channels. Each header ground contact includes shield walls forming a shield cavity. The shield walls include an end wall extending between a first side wall and a second side wall. The shield cavity receives at least one of the header signal contacts to provide electrical shielding for the at least one header signal contacts. Each header ground contact includes a mating protrusion that extends outward relative to the shield cavity from the corresponding shield wall. The mating protrusion is configured to engage a conductive insert of the receptacle assembly used to electrically common each of the header ground contacts.

In another embodiment, a header assembly is provided. The header assembly includes a header housing having a header cavity between a mating end of the header housing and a base wall of the header housing. The mating end is configured to be mated with a receptacle assembly. the base wall includes signal contact channels and ground contact channels. The header assembly includes header signal contacts received in corresponding signal contact channels. The header signal contacts have mating ends arranged in the header cavity for mating with the receptacle assembly. The header assembly includes header ground contacts received in corresponding ground contact channels. Each header ground contact includes an end wall that extends between a first side wall and a second side wall to form a shield cavity. The shield cavity receives at least one of the header signal contacts to provide electrical shielding for the at least one header signal contacts. Each header ground contact includes a first mating beam extending from the first side wall and a second mating beam extending from the second side wall. The first and second mating beams are deflectable. The first and second mating beams extend outward relative to the shield cavity. The first and second mating beams are configured to be received in a common shielded chamber of a conductive insert of the receptacle assembly. The first and second mating beams are configured to be compressed against the conductive insert to electrically common each of the header ground contacts.

In a further embodiment, an electrical connector system is provided. The electrical connector system includes a receptacle assembly comprising a receptacle housing holding receptacle signal contacts and receptacle ground contacts. The receptacle housing includes a dielectric front housing and a conductive insert coupled to a rear of the front housing. The conductive insert includes chamber walls to form shielded chambers. Each shielded chamber receives a pair of the receptacle signal contacts and the corresponding receptacle ground contacts. The electrical connector system includes a header assembly comprising a header housing holding header signal contacts and header ground contacts. The header housing has a header cavity to receive the receptacle housing. The header housing has a base wall including signal contact channels receiving corresponding header signal contacts and ground contact channels receiving corresponding header ground contacts. The header signal contacts extend into the header cavity for mating with corresponding receptacle signal contacts. The header ground contacts extend into the header cavity for mating with corresponding receptacle ground contacts. Each header ground contact includes an end wall extending between a first side wall and a second side wall forming a shield cavity. The shield cavity receives a pair of the header signal contacts to provide electrical shielding for the header signal contacts. Each header ground contact includes a mating protrusion extending outward relative to the shield cavity. The mating protrusion engages the corresponding chamber wall of the conductive insert of the receptacle assembly to electrically connect the header ground contact to the conductive insert. The conductive insert electrically commons each of the header ground contacts.

DETAILED DESCRIPTION OF THE INVENTION

Figure 1:
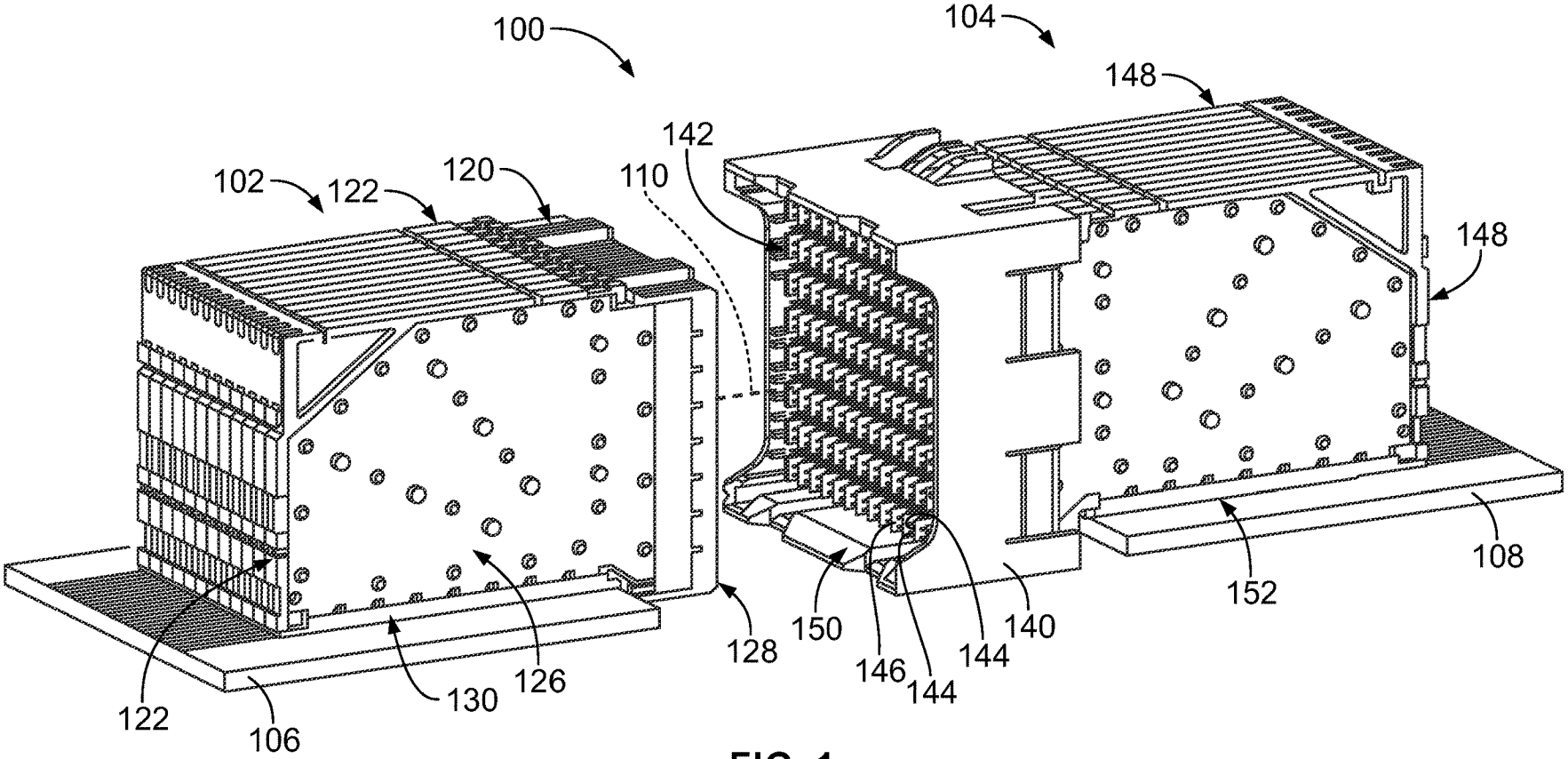
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a first connector assembly 102 and a second connector assembly 104 that may be directly mated together. The first connector assembly 102 and/or the second connector assembly 104 may be referred to hereinafter individually as a "connector assembly" or collectively as "connector assemblies". The first connector assembly 102 is a receptacle assembly and may be referred to hereinafter as a receptacle assembly 102. The second connector assembly 104 is a header assembly and may be referred to hereinafter as a header assembly 104. A mating axis 110 extends through the first and second connector assemblies 102, 104. The first and second connector assemblies 102, 104 are mated together in a direction parallel to and along the mating axis 110.

In an exemplary embodiment, the first and second connector assemblies 102, 104 are electrically connected to respective circuit boards 106, 108. The first and second connector assemblies 102, 104 are utilized to electrically connect the circuit boards 106, 108 to one another at a separable mating interface. In an exemplary embodiment, the circuit boards 106, 108 are oriented parallel to one another when the first and second connector assemblies 102, 104 are mated. Alternative orientations of the circuit boards 106, 108 are possible in alternative embodiments, such as perpendicular orientations.

The receptacle assembly 102 includes a receptacle housing 120 that holds a plurality of contact modules 122. Any number of contact modules 122 may be provided to increase the signal pin count of the receptacle assembly 102. The contact modules 122 each include a plurality of receptacle signal contacts 124 (shown in FIG. 3) that are received in the receptacle housing 120 for mating with the header assembly 104. In an exemplary embodiment, the receptacle signal contacts 124 are arranged in pairs defining differential pairs. The pairs of receptacle signal contacts 124 may be arranged in columns defining a pair-in-column connector interface. In alternative embodiments, the pairs of receptacle signal contacts 124 may be arranged in rows defining a pair-in-row connector interface.

In an exemplary embodiment, each contact module 122 has a shield structure 126 for providing electrical shielding for the receptacle signal contacts 124. In an exemplary embodiment, the shield structure 126 is electrically connected to the second connector assembly 104 and/or the circuit board 106. For example, the shield structure 126 may be electrically connected to the second connector assembly 104 by ground contacts (e.g. beams or fingers) extending from the contact modules 122 that engage the second connector assembly 104. The shield structure 126 may be electrically connected to the circuit board 106 by features, such as ground pins. In an exemplary embodiment, the receptacle housing 120 may include a shield structure. For example, the receptacle housing 120 may include a conductive insert providing shielding around the mating interfaces of the receptacle signal contacts 124. A shield structure of the header assembly 104 may be electrically connected to the conductive insert to electrically common the header assembly 104 and the receptacle assembly 102.

The first connector assembly 102 includes a mating end 128 and a mounting end 130. The receptacle signal contacts 124 are received in the receptacle housing 120 and held therein at the mating end 128, such as for mating to the second connector assembly 104. The receptacle signal contacts 124 are arranged in a matrix of rows and columns. Any number of receptacle signal contacts 124 may be provided in the rows and columns. The receptacle signal contacts 124 also extend to the mounting end 130 for mounting to an electrical component, such as the circuit board 106. Optionally, the mounting end 130 may be substantially perpendicular to the mating end 128.

The header assembly 104 includes a header housing 140 having a header cavity 142 that receives the mating end 128 of the receptacle assembly 102. The header housing 140 holds header signal contacts 144 and header ground contacts 146. The header signal contacts 144 extend into the header cavity 142 for mating with the receptacle signal contacts 124. The header ground contacts 146 extend into the header cavity 142 for mating with the shield structure of the receptacle assembly 102. In an exemplary embodiment, the header assembly 104 includes contact modules 148 received in the header housing 140. The contact modules 148 hold corresponding header signal contacts 144 and header ground contacts 146. In alternative embodiments, the header assembly 104 may be provided without the contact modules 148, such as having the header signal contacts 144 and the header ground contacts 146 held by the header housing 140 and mounted directly to a circuit board at the rear of the header housing 140.

The header assembly 104 has a mating end 150, such as a front of the header housing 140. In an exemplary embodiment, the header assembly 104 includes a mounting end 152 mounted to an electrical component, such as the circuit board 108. Optionally, the mounting end 152 may be substantially perpendicular to the mating end 150, such as at a bottom of the header assembly 104 or a side of the header assembly 104. Alternatively, the mounting end 152 may be parallel to the mating end 150, such as at a rear of the header assembly 104. In an exemplary embodiment, the header signal contacts 144 are arranged as differential pairs. The pairs of header signal contacts 144 may be arranged in columns defining a pair-in-column connector interface. Alternatively, the pairs of header signal contacts 144 may be arranged in rows defining a pair-in-row connector interface. The header ground contacts 146 are positioned between the differential pairs to provide electrical shielding between adjacent differential pairs. In the illustrated embodiment, the header ground contacts 146 are C-shaped and provide shielding on three sides of the pair of header signal contacts 144. Other shapes are possible in alternative embodiments.

Figure 2:
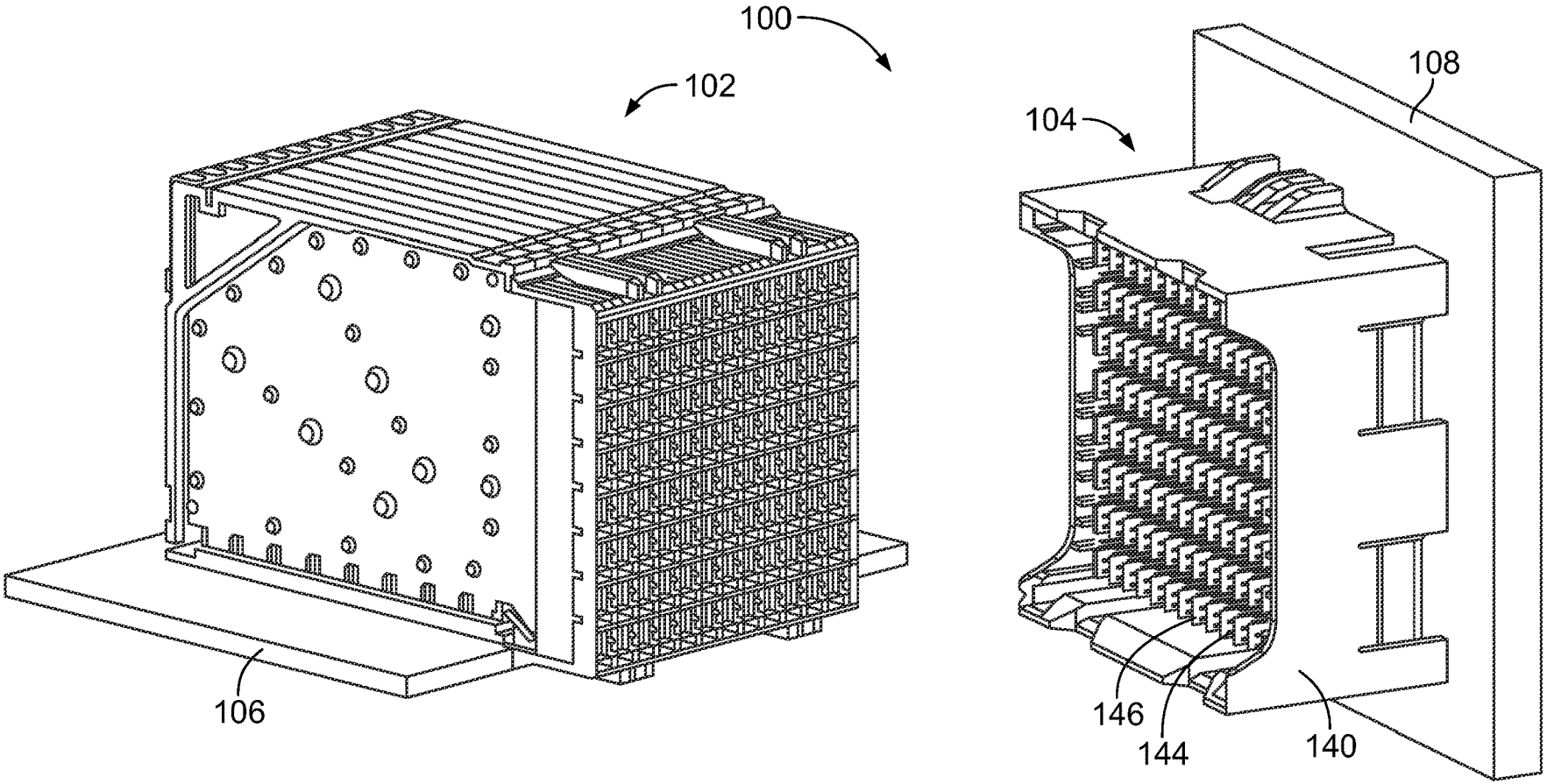
FIG. 2 is a perspective view of an exemplary embodiment of the electrical connector system illustrating the receptacle assembly and the header assembly in accordance with an exemplary embodiment.

FIG. 2 is a perspective view of an exemplary embodiment of the electrical connector system 100 illustrating the first connector assembly 102 and the second connector assembly 104. In the illustrated embodiment, the header assembly 104 is mounted to the circuit board 108 with the circuit board 108 oriented perpendicular to the circuit board 106. The header assembly 104 is provided without the contact modules 148 (shown in FIG. 1). The header signal contacts 144 and the header ground contacts 146 are held by the header housing 140 and directly mounted to the circuit board 108.

Figure 3:
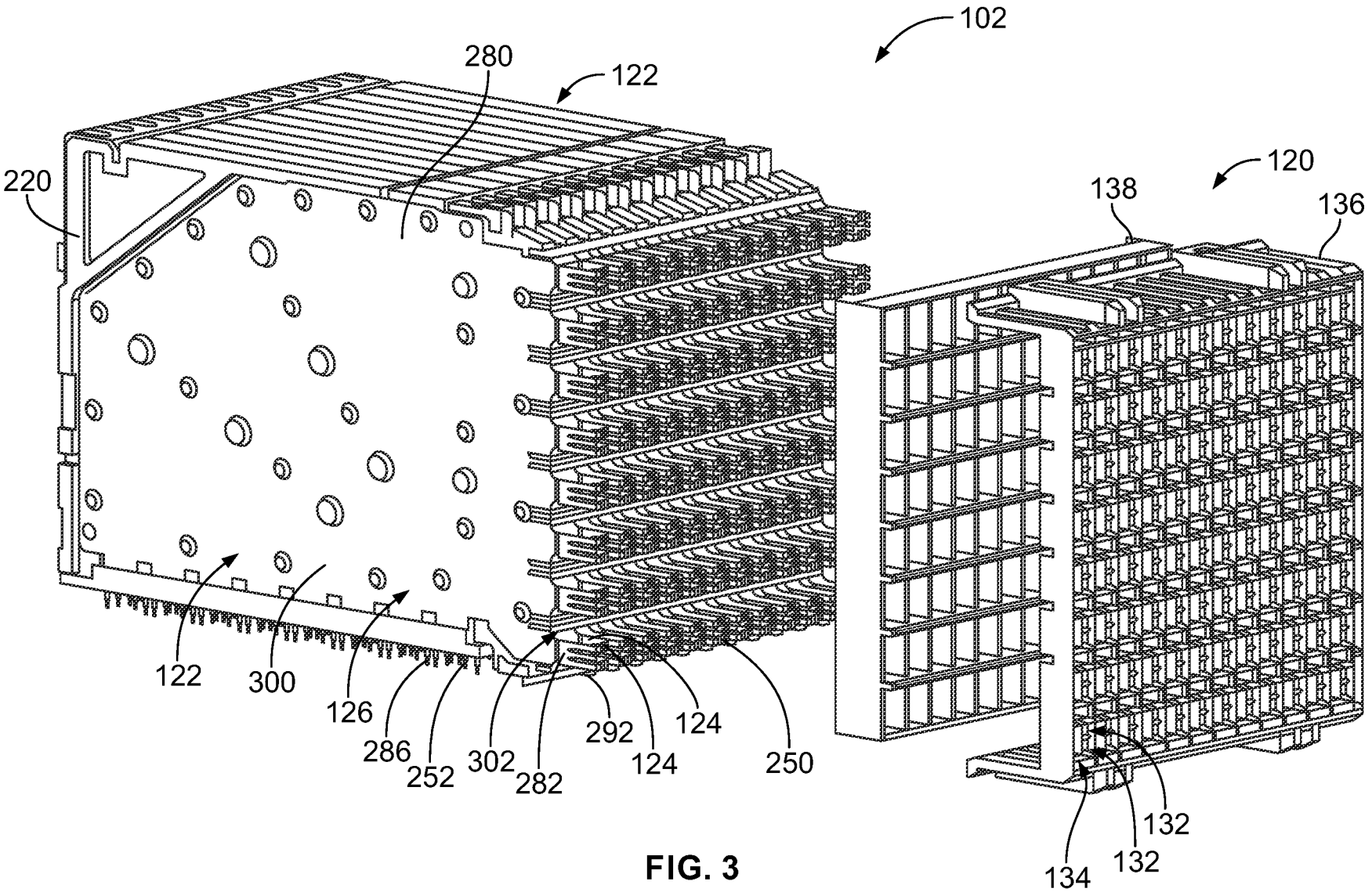
FIG. 3 is an exploded view of the receptacle assembly in accordance with an exemplary embodiment.

FIG. 3 is an exploded view of the receptacle assembly 102 in accordance with an exemplary embodiment. The receptacle assembly 102 includes the contact modules 122 and the receptacle housing 120. The receptacle housing 120 includes a front housing 136 and a conductive insert 138 coupled to the front housing 136. The front housing 136 is manufactured from a dielectric material. The conductive insert 138 forms a shielding structure of the receptacle assembly 102. The conductive insert 138 provides electrical shielding for the receptacle signal contacts 124. In various embodiments, the shield structure 126 of the contact modules 122 may be electrically connected to the conductive insert 138 such that all of the shield structures 126 of the contact modules 122 are electrically commoned by the conductive insert 138. In an exemplary embodiment, the shield structure of the header assembly 104 is electrically connected to the conductive insert 138. For example, the header ground contacts 146 (shown in FIG. 1) are electrically connected to the conductive insert 138. The conductive insert 138 is used to electrically common each of the header ground contacts 146.

The front housing 136 includes a plurality of signal contact channels 132 and a plurality of ground contact channels 134. The receptacle signal contacts 124 are received in corresponding signal contact channels 132. Optionally, a single signal contact 124 is received in each signal contact channel 132. The signal contact channels 132 may also receive corresponding header signal contacts 144 (shown in FIG. 1). The ground contact channels 134 receive ground contacts of the receptacle and header assemblies 102, 104. For example, the header ground contacts 146 are received in the ground contact channels 134. The front housing 136 is manufactured from a dielectric material, such as a plastic material, and provides isolation between the signal contact channels 132 and the ground contact channels 134. The front housing 136 isolates the receptacle signal contacts 124 and the header signal contacts 144 from the header ground contacts 146. The front housing 136 isolates each set of signal contacts 124, 144 from other sets of signal contacts 124, 144.

The contact modules 122 are stacked side-by-side in a contact module stack. The shield structure 126 provides electrical shielding between the contact modules 122. The shield structure 126 provides shielding between the receptacle signal contacts 124. In an exemplary embodiment, the shield structure 126 includes ground shields 300 arranged along one or both sides of the contact modules 122. In an exemplary embodiment, the ground shields 300 are configured to be closely coupled to the receptacle signal contacts 124 to provide electrical shielding between pairs of the receptacle signal contacts 124. The shield structure 126 includes ground tie bars 302 (also shown in FIGS. 12 and 13) extending between the ground shields 300 at the front of the contact modules 122 to electrically connect the ground shields 300. For example, the ground shields 300 may extend vertically and the ground tie bars 302 may extend horizontally. The ground tie bars 302 are separate and discrete from the ground shields 300 and coupled to the front ends of the ground shields 300. For example, the ground tie bars 302 and/or the ground shields 300 may include slots that allow fitting of the ground tie pars 302 with the ground shields 300 to form a grid or lattice of electrical shielding at the mating end of the receptacle assembly 102.

The contact module 122 includes a frame assembly 220 including a contact leadframe and a dielectric frame surrounding the contact leadframe. The leadframe defines the receptacle signal contacts 124. The leadframe is a stamped and formed structure. The dielectric frame surrounds and supports the receptacle signal contacts 124 of the leadframe. For example, the dielectric frame may be an overmolded body configured to be overmolded around the leadframe to form the dielectric frame. Other manufacturing processes may be utilized to form the contact modules 122, such as loading receptacle signal contacts 124 into a formed dielectric body. The receptacle signal contacts 124 are shaped and positioned for enhanced electrical performance at high data speed, such as to reduce cross-talk, reduce insertion loss, reduce skew, match target impedance, and the like.

The receptacle signal contacts 124 have mating portions 250 at the front of the contact module 122. The mating portions 250 may be mating beams, sockets, pins, or other types of mating portions. The mating portions 250 extend from the dielectric frame for mating with the second connector assembly 104 (shown in FIG. 1). The receptacle signal contacts 124 includes mounting portions 252 at the bottom of the contact module 122. The mounting portions 252 extend from the dielectric frame for mounting to the circuit board 106 (shown in FIG. 1). For example, the mounting portions 252 may be compliant pins, such as eye-of-the-needle pins. Other types of mounting portions 252 may be provided in alternative embodiments, such as solder tails, spring beams, and the like. In an exemplary embodiment, the mating portions 250 extend generally perpendicular with respect to the mounting portions 252.

The ground shield 300 includes a main body 280 and receptacle ground contacts 282 extending from the main body 280. In an exemplary embodiment, the ground shield 300 may be stamped and formed. The receptacle ground contacts 282 extend forward from the main body 280 such that the receptacle ground contacts 282 may be loaded into the receptacle housing 120 for mating with the header ground contacts 146 (shown in FIG. 1). The ground shield 300 includes a plurality of ground pins 286 extending from the bottom of the main body 280 for termination to the circuit board 106. The ground pins 286 may be compliant pins, such as eye-of-the-needle pins, that are press-fit into plated vias in the circuit board 106. Other types of termination means or features may be provided in alternative embodiments. The receptacle ground contacts 282 extend along sides of the mating portions 250 to provide electrical shielding between the mating portions 250 of adjacent contact modules 122.

The ground tie bars 302 include receptacle ground contacts 292 extending forward from the ground tie bars 302 such that the receptacle ground contacts 292 may be loaded into the receptacle housing 120 for mating with the header ground contacts 146 (shown in FIG. 1). The receptacle ground contacts 292 are located between the pairs of mating portions 250 within the contact modules 122.

Figure 4:
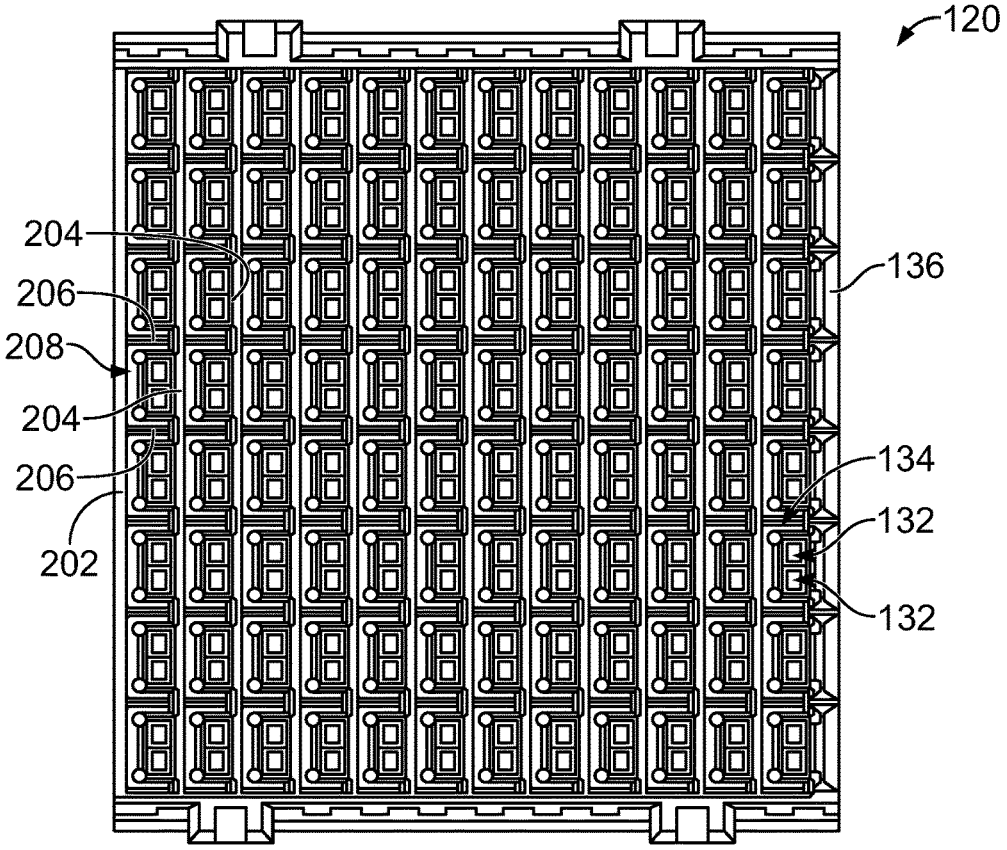
FIG. 4 is a rear view of a front housing of the receptacle assembly in accordance with an exemplary embodiment.
Figure 5:
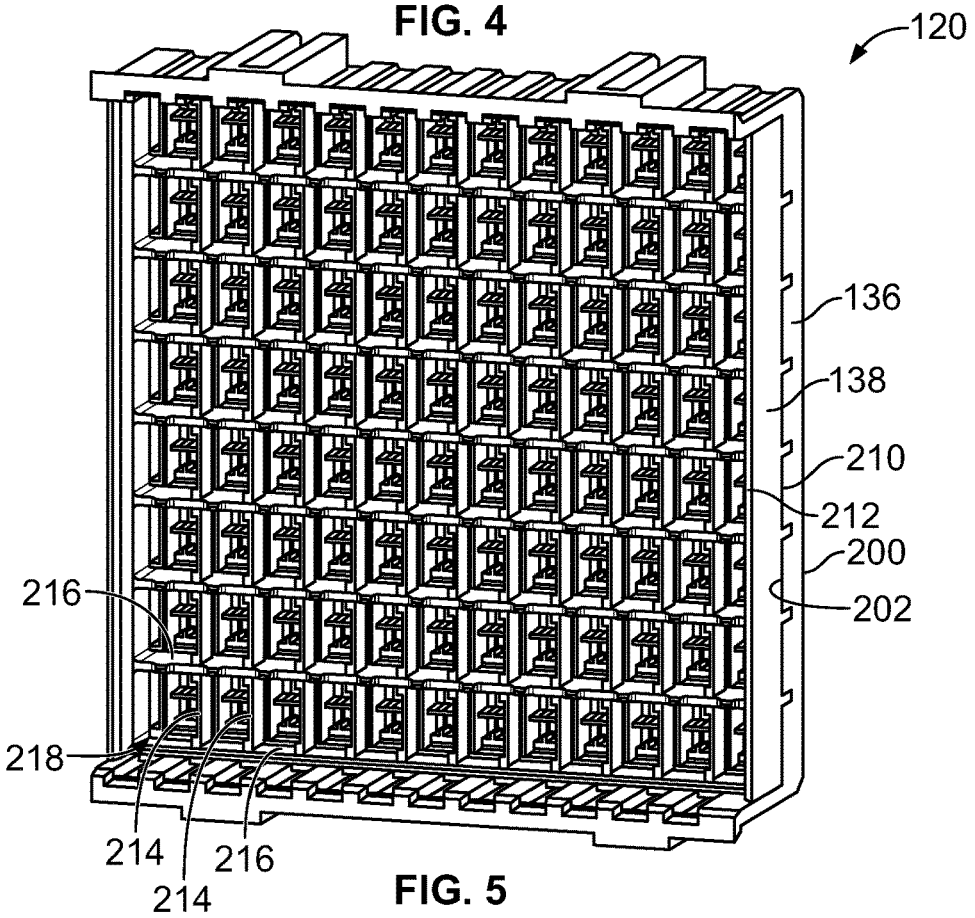
FIG. 5 is a rear perspective view of the receptacle housing showing the front housing and a conductive insert of the receptacle assembly in accordance with an exemplary embodiment.

FIG. 4 is a rear view of the front housing 136 in accordance with an exemplary embodiment. FIG. 5 is a rear perspective view of the receptacle housing 120 showing the front housing 136 and the conductive insert 138. The front housing 136 extends between a front 200 and a rear 202. The conductive insert 138 is coupled to the rear 202 of the front housing 136.

The front housing 136 includes vertical walls 204 and horizontal walls 206 forming chambers 208. In the illustrated embodiment, each chamber 208 includes one of the ground contact channels 134 that receives the receptacle ground contacts 282, 292 and one of the header ground contacts 146 and a pair of the signal contact channels 132 that receive the pairs of receptacle and header signal contacts 124, 144 (shown in FIG. 1). The ground contact channels 134 are shaped to receive the header ground contacts 146, such as being C-shaped. The front housing 136 is dielectric and separates the ground contact channels 134 from the signal contact channels 132 to electrically isolates the signal contacts 124, 144 from the header ground contacts 146.

The conductive insert 138 extends between a front 210 and a rear 212. The conductive insert 138 includes vertical walls 214 and horizontal walls 216 forming shielded chambers 218. The conductive insert 138 is manufactured from a conductive material, such as metal. The conductive insert 138 may include metal plates forming the walls 214, 216. In alternative embodiments, the walls 214, 216 may be plated plastic walls or plastic walls having embedded conductive fillers to form the walls 214, 216. In the illustrated embodiment, each shielded chamber 218 is box-shaped; however, the shielded chamber 218 may have other shapes in alternative embodiments. The shielded chamber 218 receives the receptacle ground contacts 282, 292 and one of the header ground contacts 146 and pairs of receptacle and header signal contacts 124, 144. The conductive insert 138 provides electrical shielding for the receptacle and header signal contacts 124, 144. The header ground contacts 146 are configured to be mated to interior surfaces of the vertical walls 214 and/or the horizontal walls 216.

Figure 6:
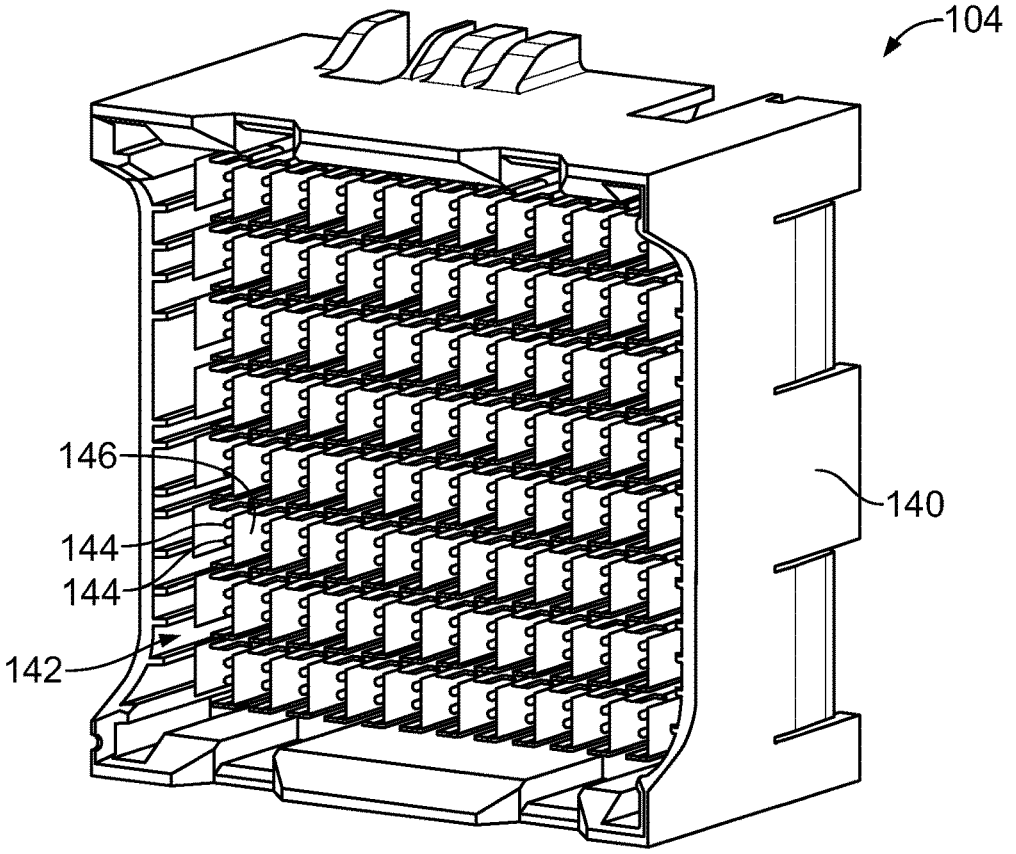
FIG. 6 is a front perspective view of the header assembly in accordance with an exemplary embodiment.
Figure 7:
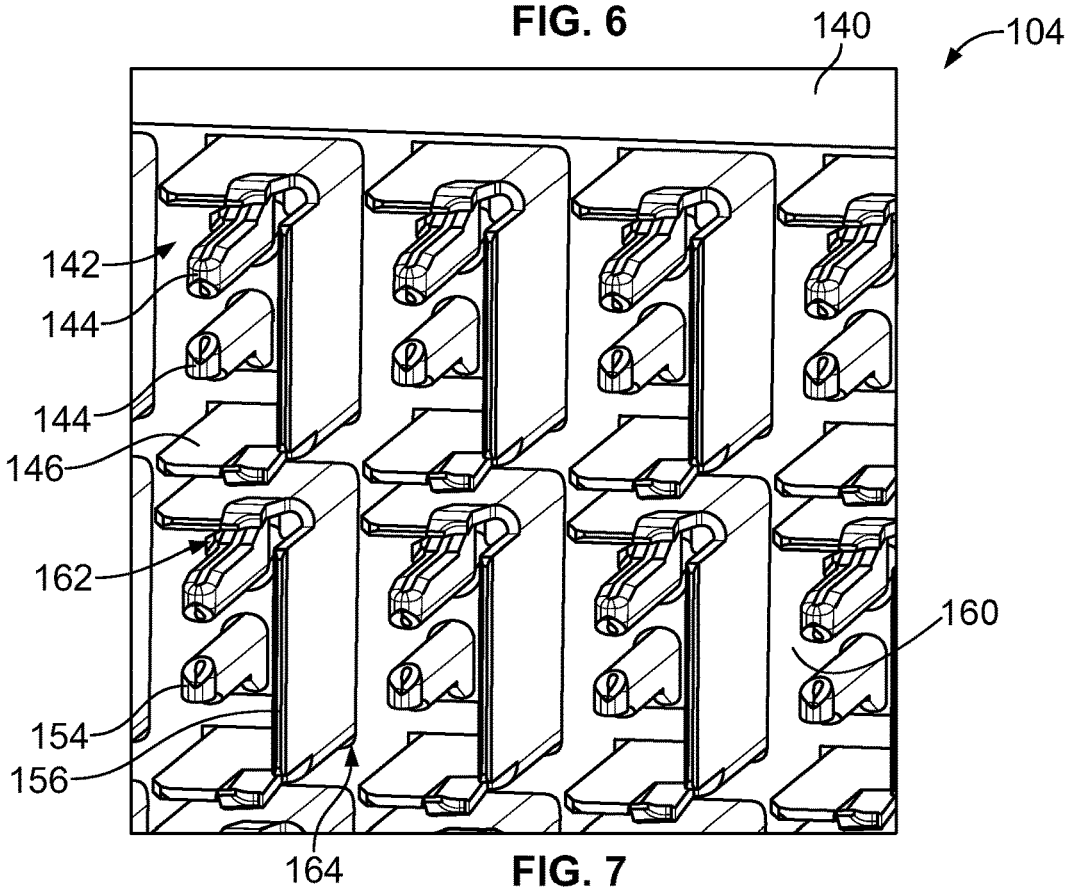
FIG. 7 is a front perspective view of a portion of the header assembly in accordance with an exemplary embodiment.

FIG. 6 is a front perspective view of the header assembly 104 in accordance with an exemplary embodiment. FIG. 7 is a front perspective view of a portion of the header assembly 104. The header housing 140 holds the header signal contacts 144 and the header ground contacts 146. In an exemplary embodiment, the header housing 140 includes a base wall 160 rearward of the header cavity 142. The base wall 160 includes signal contact channels 162 and ground contact channels 164. The header housing 140 is manufactured from a dielectric material, such as a plastic material, and provides isolation between the signal contact channels 162 and the ground contact channels 164. The header signal contacts 144 are received in corresponding signal contact channels 162. Mating ends 154 of the header signal contacts 144 extend from the base wall 160 into the header cavity 142. The ground contact channels 164 receive corresponding ground contacts 146. Mating ends 156 of the header ground contacts 146 extend from the base wall 160 into the header cavity 142.

Figure 8:
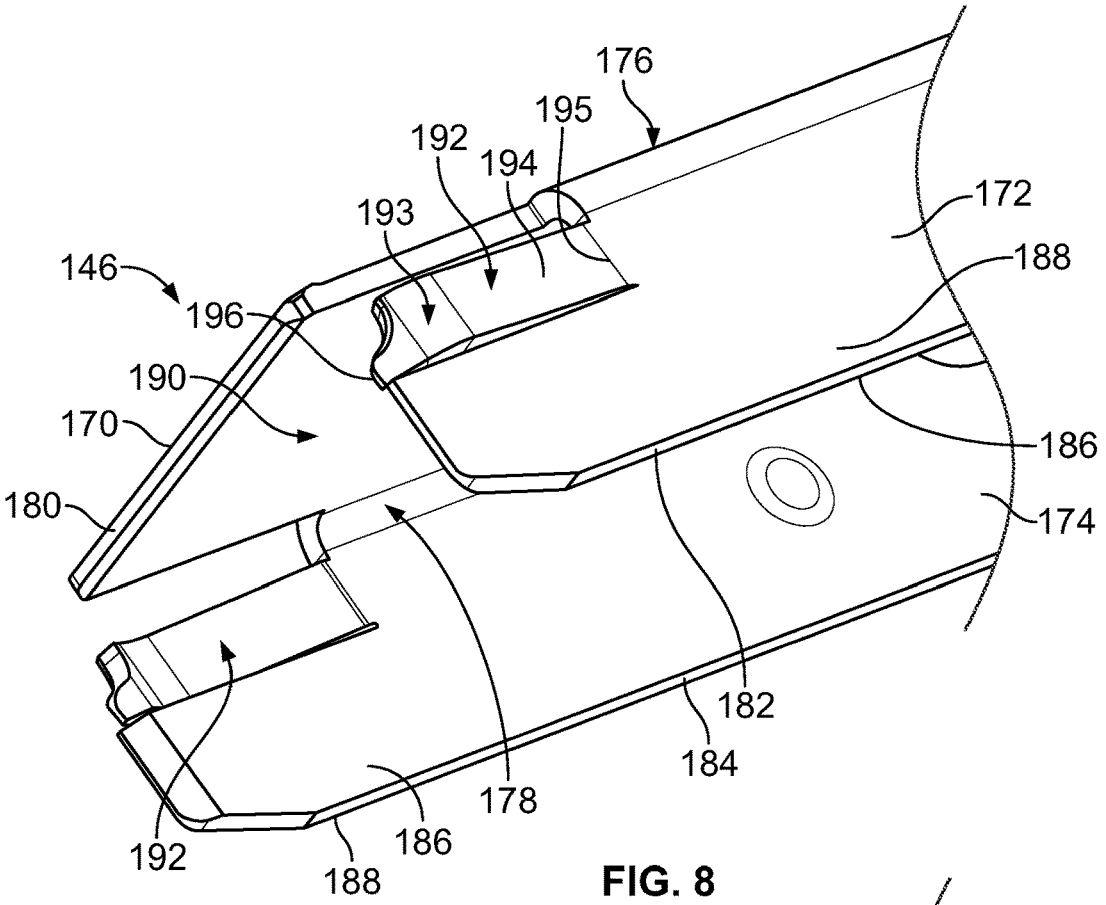
FIG. 8 is a front perspective view of a header ground contact of the header assembly in accordance with an exemplary embodiment.

FIG. 8 is a front perspective view of the header ground contact 146 in accordance with an exemplary embodiment. The header ground contact 146 includes an end wall 170 extending between a first side wall 172 and a second side wall 174. The end wall 170 meets the first side wall 172 at a first corner 176 and the end wall 170 meets the second side wall 174 at a second corner 178. The header ground contact 146 extends to a front edge 180. For example, the end wall 170, the first side wall 172 and the second side wall each extend to the front edge 180. The walls 170, 172, 174 may be chamfered at the front edge 180. The first side wall 172 extends from the end wall 170 to an outer edge 182. The second side wall 172 extends from the end wall 170 to an outer edge 184. Each of the walls 170, 172, 174 includes an interior surface 186 and an exterior surface 188. The interior surface 186 faces a shield cavity 190 of the header ground contact 146.

In an exemplary embodiment, the header ground contact 146 includes one or more mating protrusions 192 extending outward relative to the shield cavity 190. Each mating protrusion 192 includes a mating interface 193 configured to be mated to the conductive insert 138 (shown in FIG. 5) to create direct points of contact between the header ground contact 146 and the conductive insert 138. The mating interfaces 193 may be curved for sliding mating. In an exemplary embodiment, the header ground contact 146 includes multiple mating protrusions 192. For example, in the illustrated embodiment, the first side wall 172 includes one of the mating protrusions 192 and the second side wall 174 includes one of the mating protrusions 192. In alternative embodiments, the side walls 172, 174 may each include multiple mating protrusions 192. In other various embodiments, the end wall 170 may additionally or alternatively include one or more mating protrusions 192.

In an exemplary embodiment, the mating protrusion 192 includes a deflectable mating beam 194. The deflectable mating beam 194 extends from a fixed end 195 to a distal end 196. The distal end 196 may be chamfered to guide mating with the conductive insert 138. The deflectable mating beam 194 is bent outward (e.g., out-of-plane with the corresponding wall 172, 174) such that the mating interface 193 is outward of the corresponding wall 172, 174. The mating interface 193 is located proximate to the distal end 196. The mating beam 194 is deflectable inward when the header ground contact 146 is mated to the conductive insert 138. When deflected inward, the mating beam 194 is elastically deformed creating an internal spring force causing the mating beam 194 to press outward against the conductive insert 138 to maintain direct, physical electrical contact with the conductive insert 138.

The mating beam 194 is formed by cutting (e.g., shearing) the mating beam 194 from the corresponding wall 172, 174. The mating beam 194 may have a shear cut above the mating beam 194 and/or below the mating beam 194. In the illustrated embodiment, the shear cut begins at the front edge 180 and extends rearward. The mating beam 194 extends parallel to the shear cut and the outer edge 182 or 184. However, in alternative embodiments, the shear cut may begin at the outer edge 182 or 184 and extend upward toward the end wall 170.

In an exemplary embodiment, the header ground contact 146 includes mating interfaces 193 at the interior surface 186 configured to interface with the receptacle ground contacts 282, 292. The receptacle ground contacts 282, 292 engage the interior surface 186 at the mating interfaces 193. The mating interfaces 193 are located rearward of the mating protrusions 192. Optionally, the mating interfaces 193 may be offset from the mating beams 194, such as below the mating beams 194 such that the mating beams 194 do not interfere with the receptacle ground contacts 282, 292 during mating.

Figure 9:
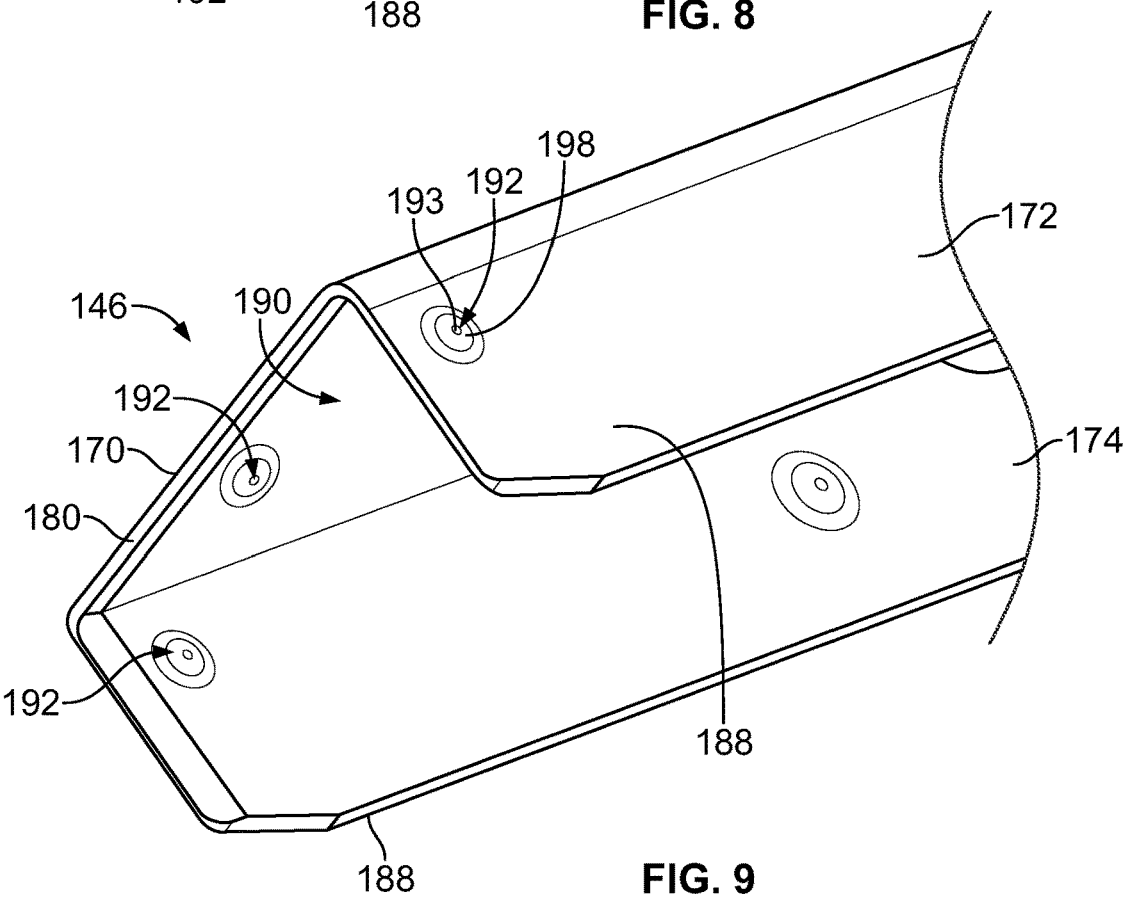
FIG. 9 is a front perspective view of the header ground contact in accordance with an exemplary embodiment.

FIG. 9 is a front perspective view of the header ground contact 146 in accordance with an exemplary embodiment. The header ground contact 146 includes the mating protrusions 192 extending outward relative to the shield cavity 190. In the illustrated embodiment, the mating protrusions 192 are provided on the side walls 172, 174 and on the end wall 170. In the illustrated embodiment, the mating protrusions 192 includes bulges 198 extending outward from the exterior surface 188. The bulges may be formed by pressing or dimpling the walls 170, 172, 174 outward to form the bulges 198. The bulges 198 include the mating interfaces 193 for engaging the conductive insert 138. The bulges 198 are provided proximate to the front edge 180.

Figure 10:
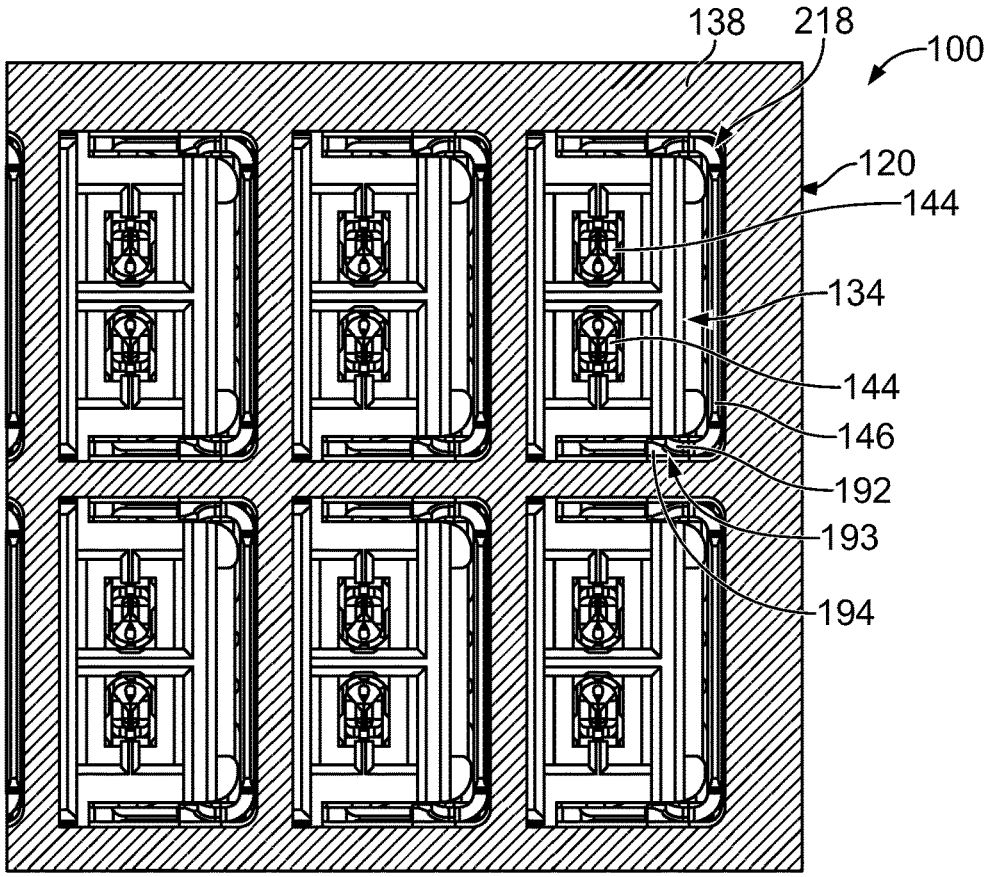
FIG. 10 illustrates a portion of the electrical connector system showing in accordance with an exemplary embodiment.
Figure 11:
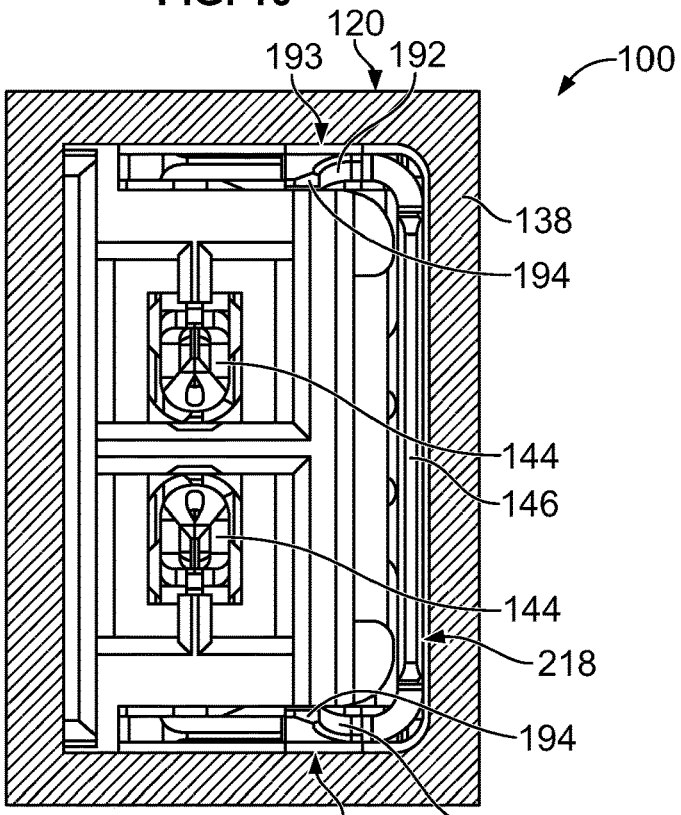
FIG. 11 is an enlarged view of a portion of the electrical connector system in accordance with an exemplary embodiment.

FIG. 10 is a cross-sectional view illustrating a portion of the electrical connector system 100 showing the header signal contacts 144 and the header ground contacts 146 received in the receptacle housing 120. FIG. 11 is a cross-sectional, enlarged view of a portion of the electrical connector system 100 showing the header signal contacts 144 and the header ground contacts 146 received in the receptacle housing 120. The header ground contacts 146 extend through the front housing 136 (in the ground contact channels 134) into the shielded chambers 218 of the conductive insert 138. The mating protrusions 192 engage the conductive insert 138 and are directly electrically connected to the conductive insert 138. For example, the deflectable mating beams 194 are spring-loaded against the walls of the conductive insert 138 such that the mating interfaces 193 are pressed outward against the conductive insert 138. The conductive insert 138 electrically commons each of the header ground contacts 146.

Figure 12:
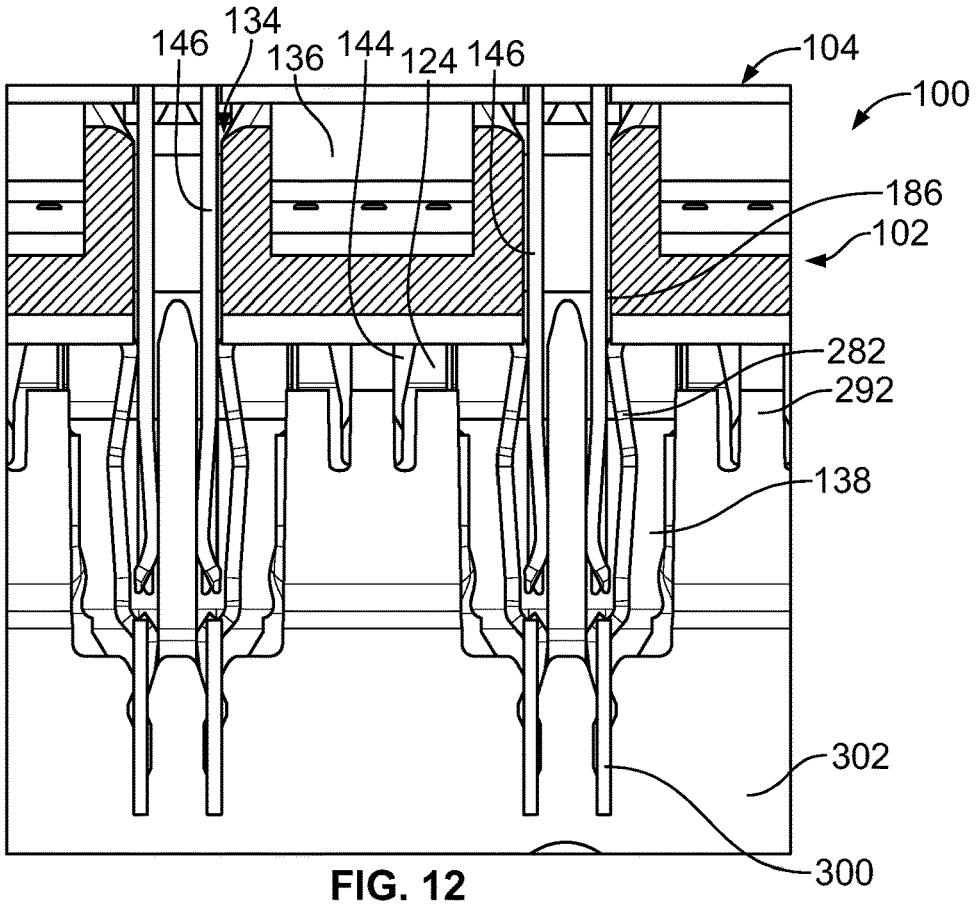
FIG. 12 is a cross-sectional view of a portion of the electrical connector system in accordance with an exemplary embodiment.
Figure 13:
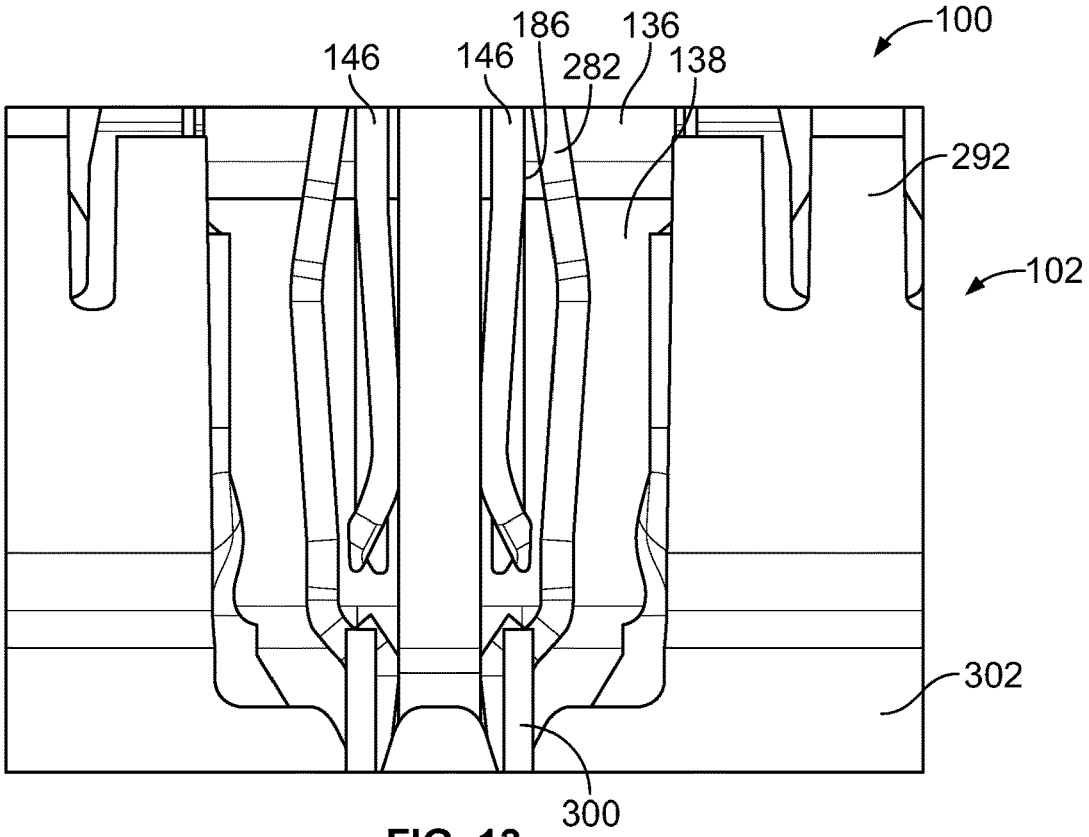
FIG. 13 is an enlarged cross-sectional view of a portion of the electrical connector system in accordance with an exemplary embodiment.

FIG. 12 is a cross-sectional view of a portion of the electrical connector system 100 showing the header assembly 104 coupled to the receptacle assembly 102. FIG. 13 is an enlarged cross-sectional view of a portion of the electrical connector system 100 showing the header assembly 104 coupled to the receptacle assembly 102. FIGS. 12 and 13 illustrate the header signal contacts 144 and the header ground contacts 146 mated with the receptacle signal contacts 124 and the receptacle ground contacts 282, 292 of the ground shields 300 and the tie bars 302. The end walls 170 of the header ground contacts 146 are removed to illustrate other components.

The header ground contacts 146 extend through the front housing 136 (in the ground contact channels 134) into the shielded chambers 218 of the conductive insert 138. The mating protrusions 192 engage the conductive insert 138 and are directly electrically connected to the conductive insert 138. For example, the deflectable mating beams 194 are spring-loaded against the walls of the conductive insert 138 such that the mating interfaces 193 are pressed outward against the conductive insert 138. The conductive insert 138 electrically commons each of the header ground contacts 146. The receptacle ground contacts 282 extend from the ground shield 300 to engage the interior surfaces 186 of the header ground contacts 146 at the mating interfaces 193 rearward of the mating protrusions 192.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header assembly comprising:

a header housing having a header cavity between a mating end of the header housing and a base wall of the header housing, the mating end configured to be mated with a receptacle assembly, the base wall including signal contact channels and ground contact channels;

header signal contacts received in corresponding signal contact channels, the header signal contacts having mating ends arranged in the header cavity for mating with the receptacle assembly;

header ground contacts received in corresponding ground contact channels, each header ground contact including shield walls forming a shield cavity, the shield walls including an end wall extending between a first side wall and a second side wall, the shield cavity receiving at least one of the header signal contacts to provide electrical shielding for the at least one header signal contacts, each header ground contact having a mating end extending forward of the base wall into the header cavity, each header ground contact includes a mating protrusion at the mating end of the header ground contact extending outward relative to the shield cavity from the corresponding shield wall, the mating protrusion located forward of the base wall in the header cavity, the mating protrusion configured to engage a conductive insert of the receptacle assembly used to electrically common each of the header ground contacts.

2. The header assembly of claim 1, wherein the header ground contacts are C-shaped.

3. The header assembly of claim 1, wherein the mating protrusions include deflectable mating beams movable relative to the shield walls when engaging the conductive insert of the receptacle assembly.

4. The header assembly of claim 1, wherein each header ground contact includes an inner surface configured to mate with a receptacle ground contact of the receptacle assembly and an exterior surface configured to face the conductive insert, the mating protrusion extending outward from the exterior surface to interface with the conductive insert.

5. The header assembly of claim 1, wherein each header ground contact includes a plurality of the mating protrusions including a first mating protrusion extending from the first side wall and a second mating protrusion extending from the second side wall.

6. The header assembly of claim 5, wherein the plurality of mating protrusions include a third protrusion extending from the end wall.

7. The header assembly of claim 5, wherein the first and second mating protrusions are deflectable mating beams extending outward from the first and second side walls away from each other, the deflectable mating beams being deflectable toward each other when the header ground contact is coupled to the conductive insert.

8. The header assembly of claim 1, wherein each header ground contact extends to a front edge, the mating protrusion being provided at the front edge.

9. The header assembly of claim 1, wherein the mating protrusion is located forward of the mating ends of the header signal contacts.

10. The header assembly of claim 1, wherein the first and second side walls meet the end wall at corners, the mating protrusion being a first mating protrusion positioned at the corner between the first side wall and the end wall, the header ground contact further comprising a second mating protrusion positioned at the corner between the second side wall and the end wall.

11. The header assembly of claim 1, wherein the first and second side walls extend from the end wall to outer edges of the first and second side walls, the mating protrusion being a first mating protrusion positioned at the outer edge of the first side wall, the header ground contact further comprising a second mating protrusion being positioned at the outer edge of the second side wall.

12. The header assembly of claim 1, wherein the mating protrusions have curved mating interfaces.

13. The header assembly of claim 1, wherein the mating protrusions include deflectable mating beams sheared from the corresponding shield walls.

14. The header assembly of claim 1, wherein the mating protrusions include bulges pressed outward from the corresponding shield walls.

15. A header assembly comprising:

a header housing having a header cavity between a mating end of the header housing and a base wall of the header housing, the mating end configured to be mated with a receptacle assembly, the base wall including signal contact channels and ground contact channels;

header signal contacts received in corresponding signal contact channels, the header signal contacts having mating ends arranged in the header cavity for mating with the receptacle assembly;

header ground contacts received in corresponding ground contact channels, each header ground contact including an end wall extending between a first side wall and a second side wall forming a shield cavity, the shield cavity receiving at least one of the header signal contacts to provide electrical shielding for the at least one header signal contacts, each header ground contact having a mating end extending forward of the base wall into the header cavity, each header ground contact includes a first mating beam at the mating end of the header ground contact extending from the first side wall and a second mating beam at the mating end of the header ground contact extending from the second side wall, the first and second mating beams being deflectable, the first and second mating beams extending outward relative to the shield cavity, the first and second mating beams located forward of the base wall in the header cavity, the first and second mating beams configured to be received in a common shielded chamber of a conductive insert of the receptacle assembly, the first and second mating beams configured to be compressed against the conductive insert to electrically common each of the header ground contacts.

16. The header assembly of claim 15, wherein each header ground contact includes an inner surface configured to mate with a receptacle ground contact of the receptacle assembly and an exterior surface configured to face the conductive insert, the mating protrusion extending outward from the exterior surface to interface with the conductive insert.

17. The header assembly of claim 15, wherein the mating protrusions have curved mating interfaces.

18. An electrical connector system comprising:

a receptacle assembly comprising a receptacle housing holding receptacle signal contacts and receptacle ground contacts, the receptacle housing including a dielectric front housing and a conductive insert coupled to a rear of the front housing, the conductive insert including chamber walls forming shielded chambers, each shielded chamber receiving a pair of the receptacle signal contacts and the corresponding receptacle ground contacts; and a header assembly comprising a header housing holding header signal contacts and header ground contacts, the header housing having a header cavity receiving the receptacle housing, the header housing having a base wall including signal contact channels receiving corresponding header signal contacts and ground contact channels receiving corresponding header ground contacts, the header signal contacts extending into the header cavity for mating with corresponding receptacle signal contacts, the header ground contacts extending into the header cavity for mating with corresponding receptacle ground contacts, each header ground contact including an end wall extending between a first side wall and a second side wall forming a shield cavity, the shield cavity receiving a pair of the header signal contacts to provide electrical shielding for the header signal contacts, each header ground contact includes a mating protrusion extending outward relative to the shield cavity, the mating protrusion engaging the corresponding chamber wall of the conductive insert of the receptacle assembly to electrically connect the header ground contact to the conductive insert, wherein the conductive insert electrically commons each of the header ground contacts.

19. The electrical connector system of claim 18, wherein each header ground contact includes a second mating protrusion, each header ground contact having multiple points of contact with the conductive insert.

20. The electrical connector system of claim 18, wherein each header ground contact includes an interior surface and an exterior surface, the receptacle ground contact being compressible against the interior surface of the corresponding header ground contact, the mating protrusion extending from the exterior surface to interface with the conductive insert.

* * * * *